United States Patent [19]

Miyao et al.

[11] Patent Number: 5,073,305

[45] Date of Patent: Dec. 17, 1991

[54] METHOD OF EVACUATING RADIOACTIVE WASTE TREATING CONTAINER TO VACUUM

[75] Inventors: Hidehiko Miyao, Katsuta; Masao Shiotsuki; Shigeyoshi Kawamura, both of Mito; Fumiaki Komatsu, Kobe, all of Japan

[73] Assignees: Kabushiki Kaisha Kobe Seiko Sho, Kobe; Doryokuro Kakunenryo, Tokyo, both of Japan

[21] Appl. No.: 569,976

[22] Filed: Aug. 20, 1990

[30] Foreign Application Priority Data

Sep. 28, 1989 [JP] Japan ..... 1-253856

[51] Int. Cl.[5] ..... G21F 9/12

[52] U.S. Cl. ..... 252/633; 252/626; 252/628; 252/629; 250/506.1; 376/261; 376/272

[58] Field of Search ..... 252/626, 628, 629, 633; 264/0.5; 250/506.1; 376/261, 272

[56] References Cited

U.S. PATENT DOCUMENTS

| | | | |
|---|---|---|---|
| 4,139,488 | 2/1979 | Knotik et al. | 252/628 |
| 4,280,921 | 7/1981 | May | 252/628 |
| 4,437,578 | 3/1984 | Bienek et al. | 220/256 |
| 4,491,540 | 1/1985 | Larker et al. | 252/628 |
| 4,581,162 | 4/1986 | Kawamura et al. | 252/628 |
| 4,582.674 | 4/1986 | Stritzke | 376/272 |
| 4,642,204 | 2/1987 | Burstrom et al. | 252/633 |
| 4,643,869 | 2/1987 | Heimerl et al. | 376/272 |
| 4,654,171 | 3/1987 | Boncoeur et al. | 252/626 |
| 4,808,337 | 2/1989 | Ramm et al. | 252/628 |
| 4,929,394 | 5/1990 | Kitagawa et al. | 252/633 |

*Primary Examiner*—Brooks H. Hunt
*Assistant Examiner*—Ngoclan T. Mai
*Attorney, Agent, or Firm*—Oblon, Spivak, McClelland, Maier & Neustadt

[57] ABSTRACT

A method of evacuating a container to a vacuum for use in treating radioactive wastes by placing the waste into the container, evacuating, sealing off and thereafter compressing the container, the method being characterized by placing the waste into the container, forming over the waste a filter layer of particulate material fulfilling one of the following requirements: and sealing off and compressing the container.

(1) A layer having a thickness of at least 5 mm and formed of a particulate material not smaller than 40 μm to less than 105 μm in mean particle size;

(2) A layer having a thickness of D in mm and formed of a particulate material not smaller than 105 μm to not greater than 210 μm in mean particle size d in μm, the thickness D and the mean particle size d having the relationship represented by:

$$D \geqq (20/105) \times d - 15;$$

and thereafter aspirating a gas through the filter layer from thereabove to evacuate the container and sealing off and compressing the container.

9 Claims, 2 Drawing Sheets

METHOD OF EVACUATING RADIOACTIVE WASTE TREATING CONTAINER TO VACUUM

BACKGROUND OF THE INVENTION AND RELATED ART STATEMENT

The present invention relates to a method of evacuating treating containers to a vacuum for use in compacting radioactive wastes by an HIP (hot isostatic press), hot press or the like. Such radioactive wastes include metals and bricks contaminated with plutonium or a transuranium element having a long half life.

In recent years, attention has been directed to treatments by HIP or the like for compacting radioactive wastes into solid blocks for stabilization before storing the wastes (see, for example, Examined Japanese Patent Publication SHO 57-959).

For example, the treatment of hulls will be described which are sheared cladding tubes. Hulls are hollow, have a low bulk density of 1.0 and are therefore precompressed to a true density ratio of at least about 70% by a press first. During the compression, a highly radioactive oxide formed by zircalloy on the surfaces of the hulls and having a thickness of about 10 μm partly separates off.

The compressed waste is then placed into a treating container of stainless steel or the like, which is then filled with a metal powder, stainless steel powder or the like to eliminate the space or clearances remaining in the container. A closure is then welded to the container, piping (hereinafter referred to as an "evacuating pipe") is thereafter attached to the closure for connection to a vacuum pump, and the interior of the container is evacuated to a degree of vacuum, e.g., about $10^{-2}$ torr. The container thus evacuated is completely sealed off to hold the vacuum therein, and the container is compressed by HIP or hot press under an external pressure with heating, whereby the container is compacted. The container is evacuated to prevent the container itself from breaking owing to the presence of air or like gas confined in the container when the container is compressed under a high pressure.

However, if the container is thus evacuated after the waste has been placed thereinto, a particulate radioactive substance separating off the waste is led out of the container via the evacuating pipe to contaminate the vacuum pump and the inner surface of the evacuating pipe. The spillage of the radioactive substance due to aspiration can not be prevented completely even at a reduced evacuation rate. Further even if a filter is removably installed in the evacuating pipe and the like, the filter becomes contaminated and is therefore extremely difficult to replace, hence inconvenience is caused.

SUMMARY OF THE INVENTION

The main object of the present invention is to provide a method of evacuating treating containers to a vacuum free of the foregoing problem.

To fulfill this object, the present invention provides a method of evacuating a container to a vacuum for use in treating radioactive wastes by placing the waste into the container, and evacuating, sealing off and thereafter compressing the container, the method being characterized by placing the waste into the container, forming over the waste a filter layer of particulate material fulfilling one of the following requirements, and thereafter aspirating a gas through the filter layer from thereabove to evacuate the container and sealing off the container.

(1) A layer having a thickness of at least 5 mm and formed of a particulate material not smaller than 40 μm to less than 105 μm in mean particle size.

(2) A layer having a thickness of D mm and formed of a particulate material not smaller than 105 μm to not greater than 210 μm in mean particle size d μm, the thickness D and the mean particle size d having the relationship represented by:

$$D \geqq (20/105) \times d - 15$$

With the method described above, the gas within the container is drawn out through the interstices between the particles of the particulate material, whereas the radioactive substance separating off the waste is blocked by the filter layer fulfilling the specified requirement and is prevented from being led out of the container. Accordingly, the present method satisfactorily evacuates the container while reliably preventing the release of the radioactive substance from the container. The filter layer is subjected to the compacting treatment along with the container and therefore need not be replaced.

The above and other objects, features and advantages of the present invention will become apparent upon a reading of the following detailed description and the accompanying drawings.

DESCRIPTION OF THE PREFERRED EMBODIMENTS

Figure 1:
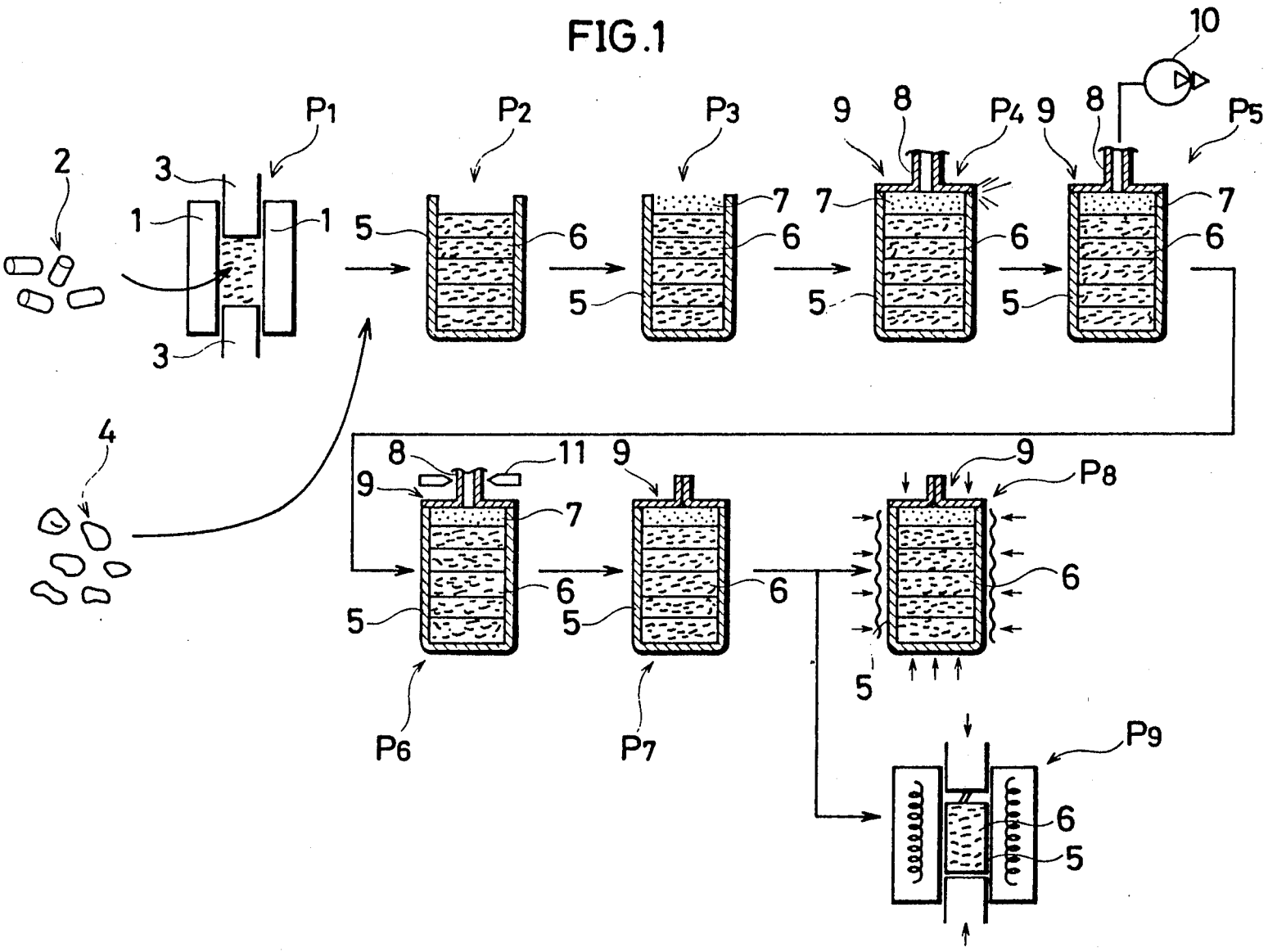
FIG. 1 is a diagram showing a process for compacting radioactive wastes in which the method of the invention is practiced.

FIG. 1 shows a process for compacting radioactive wastes wherein the method of the invention is practiced.

First in step P1, a die 1 is filled with radioactive wastes, i.e., hulls (fuel claddings as sheared after use) 2, which are then pressed (precompressed) by plungers 3.

The precompressed hulls 2 are placed into a treating container 5 along with other blocks of waste 4, if any (step P2). The amount of waste 6 thus charged in is such that a clearance of predetermined thickness will be left inside the container 5 at its upper end. A metal powder, ceramic powder or like particulate material is filled into the clearance to form a filter layer 7 (step P3).

Figure 2:
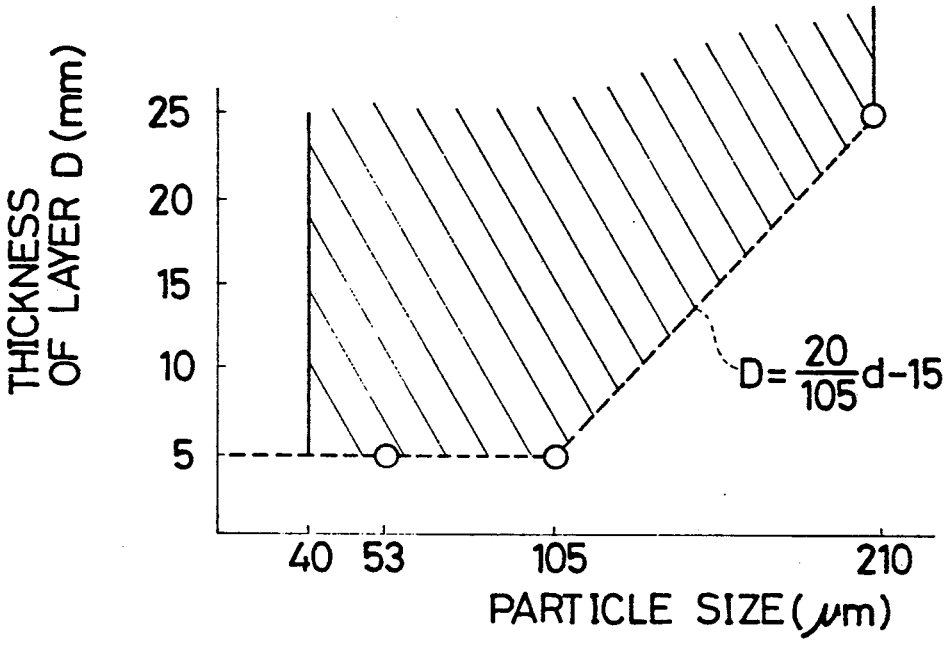
FIG. 2 is a graph showing the requirements for forming the filter layer for use in the present method.

The filter layer 7 is so formed as to fulfill the requirements represented by the hatched area of the graph of FIG. 2. More specifically stated, the mean particle size of the particulate material forming the filter layer 7 and the thickness of the layer 7 need to fulfill one of the following requirements.

(1) The mean particle size is not smaller than 40 μm to less than 105 μm, and the thickness is at least 5 mm.

(2) The mean particle size is not smaller than 105 μm to not greater than 210 μm, and assuming that the mean particle size is d μm and the thickness of the layer is D mm, the layer 7 has the following relationship between this size and the thickness.

$D \geqq (20/105) \times d - 15$

The reason for determining these requirements will be described later.

The clearance inside the container 5 around the waste 6 to be treated is also filled up with the metal powder or like particulate material.

Next, the opening of the treating container 5 is closed with a closure 9 provided with an evacuating pipe 8, and the closure 9 is joined to the container 5 by welding the outer periphery of the closure to the container (step P4). The evacuating pipe 8 is then connected to a vacuum pump 10, which in turn is operated to evacuate the interior of the container 5 (step P5). At this time, the gas inside the treating container 5 is drawn out of the container through the interstices between the particles forming the filter layer 7, whereas the radioactive substance separating off the waste 6 is blocked by the filter layer 7 which fulfills the foregoing requirement, and is prevented from being led out of the container.

After the container has been evacuated completely in this way, the evacuating pipe 8 is collapsed by a sealing device 11 to seal off the container 5 (step P6), which is then checked for leaks (step P7). The container 5 is compressed hot in its entirety by HIP (step P8) or hot press (step P9), whereby the radioactive waste 6 accommodated in the container 5 is compacted and further made stabilized through diffusion and bonding actions between the blocks of waste treated.

Figure 3:
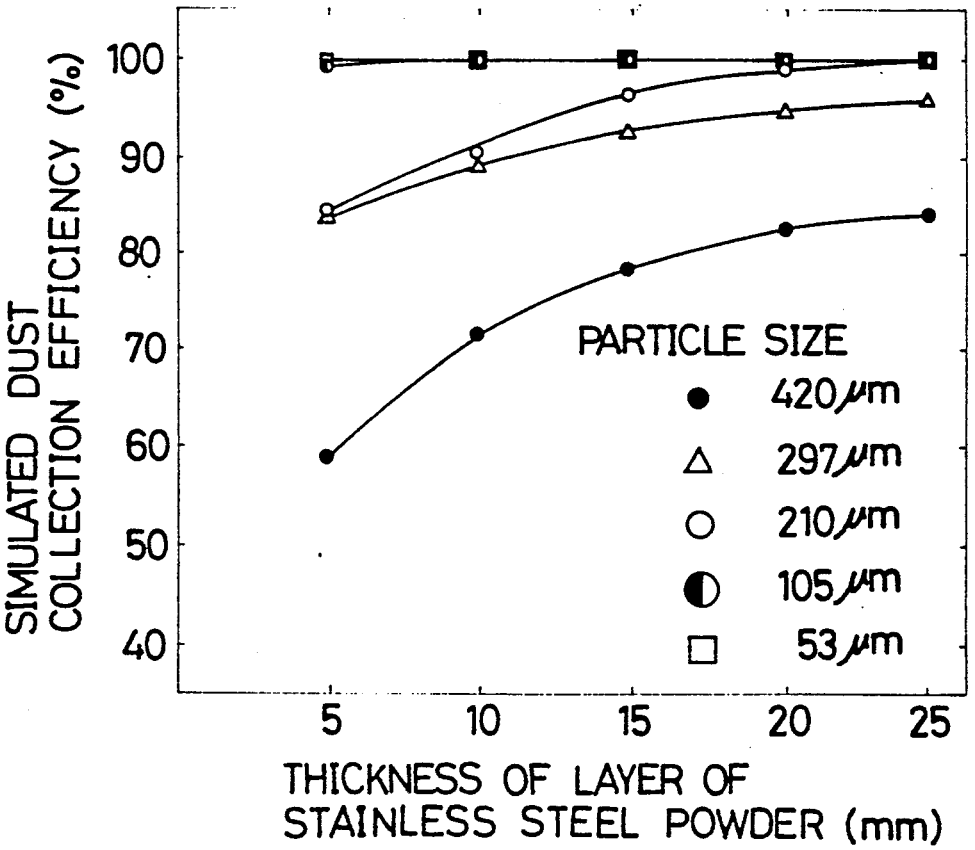
FIG. 3 is a graph showing the result of a simulation test conducted to determine the requirements.

FIG. 3 shows the result of a simulation test conducted for determining the requirements for the filter layer 7 using as a simulated radioactive powder a commercial clay powder (trade name: Arizona Roaddust) which is widely used for filter trapping tests. A 5 g quantity of the clay powder was passed through a glass tube, 30 mm in diameter, at a flow rate of 22.5 liters/min. The glass tube was provided at an intermediate portion thereof with a filter layer having a predetermined thickness and formed of globular stainless steel particles with a predetermined size. The clay powder passing through the filter layer was trapped with a membrane filter, 0.8 μm in pore size, to measure the amount thereof. Table 1 below shows the particle size distribution of the clay powder. Table 2 shows the particles sizes of stainless steel powders used for forming different filter layers, and the thicknesses of the layers.

With reference to FIG. 3, the simulated radioactive powder can be collected 100% when the layer is made of particles of up to 105 μm in size and has a thickness of 5 mm. Further with particles of 210 μm in size, a collection efficiency of 100% can be achieved if the layer is 25 mm in thickness. However, if the particle size exceeds 210 μm, the improvement in the collection efficiency is small even when the layer has a thickness of larger than 25 mm, and it is substantially impossible to achieve a collection efficiency of 100%. When the particle size is less than 40 μm, the interstices between the particles are too small, with the result that the layer causes an exceedingly great pressure loss and offers great resistance, hence a reduced evacuation efficiency. Because of such limitations of particle size, the thickness of the layer must be at least 5 mm at all times.

Consequently, the contamination due to the aspiration of radioactive substance can be completely prevented with use of filters fulfilling the requirements represented by the hatched area of FIG. 2.

TABLE 1

Particle Size Distribution of Clay Powder

| Particle size (μm) | <1 | 1.5 | 2 | 3 | 4 | 6 | 8 | 12 |
|---|---|---|---|---|---|---|---|---|
| Proportion (%) | 4.4 | 2.1 | 6.6 | 6.7 | 4.3 | 6.5 | 6.3 | 7.7 |

TABLE 1-continued

Particle Size Distribution of Clay Powder

| Particle size (μm) | 16 | 24 | 32 | 48 | 64 | 96 | 128 | 192 |
|---|---|---|---|---|---|---|---|---|
| Proportion (%) | 7.0 | 9.8 | 8.3 | 14.4 | 7.4 | 6.7 | 1.3 | 0.5 |

TABLE 2

Requirements for Filter Layer

| Particle size of stainless steel powder (μm) | 53 | 105 | 210 | 297 | 420 |
|---|---|---|---|---|---|
| Thickness of layer of stainless steel powder (mm) | 5 | 10 | 15 | 20 | 25 |

The particulate materials usable for forming the filter layer 7 according to the invention include, besides metal powders and stainless steel powder as mentioned above, ceramic powders such as $ZrO_2$ and $SiO_2$. Further the treating container 5 is not specifically limited in shape. The same advantage as above can be obtained, for example, by stretchable or contractable containers of the bellows type.

Although the present invention has been fully described by way of example with reference to the accompanying drawings, it is to be understood that various changes and modifications will be apparent to those skilled in the art. Therefore, unless otherwise such changes and modifications depart from the scope of the invention, they could be construed as being included therein.

What is claimed is:

1. A method of evacuating a container to a vacuum for use in treating radioactive wastes by placing the waste into the container, and evacuating, sealing off and thereafter compressing the container, the method comprising the steps of:

placing the waste into the container, forming over the waste a filter layer formed substantially entirely of particulate material fulfilling one of the following requirements:

(1) a layer having a thickness of at least 5 mm and formed of a particulate material not smaller than 40 μm to less than 105 μm in mean particle size;

(2) a layer having a thickness of D in mm and formed of a particulate material not smaller than 105 μm to not greater than 210 μm in mean particle size d in μm, the thickness D and the mean particle size d having the relationship represented by:

$D \geqq (20/105) \times d - 15$;

thereafter aspirating a gas through the filter layer from thereabove to evacuate the container and sealing off and compressing the container.

2. A method as defined in claim 1 wherein a closure provided with an evacuating pipe is welded to the container after the filter layer has been formed, and the gas is aspirated through the evacuating pipe.

3. A method as defined in claim 2 wherein the container is sealed off by collapsing the evacuating pipe.

4. A method as defined in any one of claims 1 to 3 wherein the radioactive waste comprises a hull.

5. A method as defined in any one of claims 1 to 3 wherein the radioactive waste comprises a hull and a block of waste to be treated.

6. A method as defined in any one of claims 1 to 3 wherein the container is a stretchable or contractable container of the bellows type.

7. A method as defined in any one of claims 1 to 3 wherein the particulate material is a metal powder.

8. A method as defined in any one of claims 1 to 3 wherein the particulate material is a stainless steel powder.

9. A method as defined in any one of claims 1 to 3 wherein the particulate material is a ceramic powder.

* * * * *